US008931382B2

(12) United States Patent
Weber

(10) Patent No.: US 8,931,382 B2
(45) Date of Patent: Jan. 13, 2015

(54) APPARATUS AND METHOD FOR SLICING OF FOOD PRODUCTS

(75) Inventor: Günther Weber, Nemerow (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 600 days.

(21) Appl. No.: 13/072,120

(22) Filed: Mar. 25, 2011

(65) Prior Publication Data

US 2011/0232440 A1 Sep. 29, 2011

(30) Foreign Application Priority Data

Mar. 25, 2010 (DE) ..... 10 2010 012 709

(51) Int. Cl.

| | |
|---|---|
| ***B26D 1/00*** | (2006.01) |
| ***B26D 7/01*** | (2006.01) |
| ***B26D 5/20*** | (2006.01) |
| ***B26D 7/06*** | (2006.01) |
| ***B26D 7/12*** | (2006.01) |
| ***B26D 7/26*** | (2006.01) |
| *B26D 5/02* | (2006.01) |

(52) U.S. Cl.

CPC ..... *B26D 7/01* (2013.01); *B26D 7/0683* (2013.01); *B26D 7/12* (2013.01); *B26D 7/2628* (2013.01); *B26D 5/02* (2013.01); *B26D 2007/013* (2013.01); *B26D 2210/02* (2013.01)

USPC ..... 83/34; 83/72; 83/75; 83/75.5; 83/76.1; 83/76.6; 83/76.7

(58) Field of Classification Search

USPC ..... 83/500–503, 76.7, 76.8, 932, 72–75, 83/676, 673, 663, 34, 35, 75.5; 408/2, 10, 408/13

See application file for complete search history.

(56) References Cited

U.S. PATENT DOCUMENTS

| | | | | |
|---|---|---|---|---|
| 5,267,168 | A * | 11/1993 | Antonissen et al. | 700/117 |
| 5,718,615 | A * | 2/1998 | Boucher et al. | 451/5 |
| 6,014,919 | A * | 1/2000 | Jacobsen et al. | 83/282 |
| 6,553,880 | B2 * | 4/2003 | Jacobsen et al. | 83/75 |
| 6,561,069 | B2 * | 5/2003 | Krauss et al. | 83/490 |
| 6,761,615 | B2 * | 7/2004 | Cohen | 451/6 |
| 6,766,720 | B1 * | 7/2004 | Jacobsen et al. | 83/75 |

(Continued)

FOREIGN PATENT DOCUMENTS

| | | |
|---|---|---|
| DE | 195 18 597 A1 | 11/1996 |
| DE | 19900593 A1 | 7/2000 |

(Continued)

OTHER PUBLICATIONS

European Search Report dated Jul. 8, 2011 for European Patent Application No. 11 0002 383.5, with English language translation, 8 pages.

(Continued)

*Primary Examiner* — Omar Flores Sanchez

(57) ABSTRACT

An apparatus for slicing food products includes a product feed which feeds a product to be sliced along a product feed direction through a cutting plane in which at least one cutting blade moves. The position of the cutting blade is adjustable relative to the product. A control unit is provided which is designed to automatically adjust the position of the cutting blade for the optimization of the blade wear.

23 Claims, 3 Drawing Sheets

(56) References Cited

U.S. PATENT DOCUMENTS

| | | | | |
|---|---|---|---|---|
| 6,935,215 | B2 * | 8/2005 | Lindee et al. | 83/74 |
| 7,073,419 | B2 * | 7/2006 | Weber | 83/14 |
| 7,971,510 | B2 * | 7/2011 | Weber | 83/13 |
| 2001/0054345 | A1 * | 12/2001 | Krauss et al. | 83/703 |
| 2002/0050198 | A1 * | 5/2002 | Kuchler | 83/76.8 |
| 2005/0120844 | A1 * | 6/2005 | Weber | 83/35 |
| 2007/0051217 | A1 * | 3/2007 | Weber | 83/13 |

FOREIGN PATENT DOCUMENTS

| | | | |
|---|---|---|---|
| DE | 100 37 709 | A1 | 2/2002 |
| DE | 101 43 508 | A1 | 3/2003 |
| DE | 101 48 595 | A1 | 4/2003 |
| DE | 10148595 | A1 | 4/2003 |
| DE | 10 2004 006 120 | A1 | 8/2005 |
| DE | 102004006120 | A1 | 8/2005 |
| DE | 10 2004 033 568 | A1 | 9/2006 |
| DE | 10 2006 037 856 | A1 | 2/2008 |
| DE | 102006037856 | A1 | 2/2008 |
| DE | 10 2008 019 776 | A1 | 10/2009 |
| DE | 10 2009 011 860 | A1 | 9/2010 |

OTHER PUBLICATIONS

German Search Report dated Feb. 17, 2011 issued in German Patent Application No. 10 2010 012 709.4, 4 pages, with English translation, 5 pages.

* cited by examiner

APPARATUS AND METHOD FOR SLICING OF FOOD PRODUCTS

CROSS-REFERENCE TO RELATED APPLICATION(S)

This application claims priority from German Patent Application No. DE 10 2010 012 709.4, filed Mar. 25, 2010, entitled "APPARATUS AND METHOD FOR SLICING OF FOOD PRODUCTS," which is fully incorporated herein by reference.

TECHNICAL FIELD

The present invention relates generally to production of food products and, more particularly, to a method and a corresponding apparatus for slicing a food product.

SUMMARY OF THE INVENTION

The present invention relates to a method for slicing of food products, in particular by means of a high-performance slicer, in which a product to be sliced is fed along a product-feed direction by means of a product feed through a cutting plane in which at least one cutting blade moves, in particular in a rotary manner and/or a revering manner. The invention further relates to a corresponding apparatus for slicing a food product.

The cutting blade can, for example, be a circular blade revolving in a planetary motion. Alternatively also a sickle blade or a spiral blade can be provided which rotates about an axis of rotation and has a spiral shaped blade edge. Due to the cutting edge moving in the cutting plane at a high slicing sequence, slices of a fed food product, such as, for example, meat, sausage or cheese, can be sliced. The cut-off product slices fall away from the cutting blade on the side remote from the product feed and can be delivered to a further process.

In particular, on operation of high performance slices, the respective cutting blades are subjected to high mechanical loads which cause a continuous wear of the cutting blade. Due to this blade wear the cutting blades have to be sharpened or even be completely swapped at relatively short time intervals which is associated with high operation costs.

For this reason, it is an object of the invention to make the operation of cutting apparatuses of the mentioned kind more efficient and, in particular, to increase the lifetime of the cutting blade.

This object is satisfied by a method in which a product to be sliced is fed along a product feed direction by means of a product feed through a cutting plane. At least one cutting blade moves in a rotary manner and/or a revolving manner. The position of the cutting blade is automatically adjusted relative to the product for the optimization of the blade wear.

In accordance with the invention for the optimization of the blade wear, the position of the cutting blade is automatically adjusted relative to the product. Through such an automatic adjustment it is prevented that always the same position of the blade edge is incident on the product, on cutting, which would be the case, in particular for sickle blades. The load of the cutting blade can thus be distributed over a larger area of the blade edge, whereby the point wear—which ultimately is the decisive factor with regard to the maintenance—is reduced. In this manner, the cutting blade can therefore be operated longer without interruptions than for a steady relative position between cutting blade and product. The invention considers, in particular, the recognition that the position of the cutting blade relative to the product—which is typically optimized with regard to the slice quality—can be varied within certain boundaries, without this leading to a significant degradation of the slice quality. As a whole, the efficiency of a slicing apparatus can be considerably improved through the invention, as the intervals between required sharpening processes or exchange processes can be extended.

Many advantageous modifications of the invention are possible and anticipated, some examples of which are described in details below and shown in the drawings.

Preferably, the automatic adjustment of the position takes place during the slicing. The slicing operation is thus not interrupted for the adjustment, but can continue unhindered which is beneficial for the effectiveness of the slicing apparatus.

In accordance with an embodiment, the automatic adjustment of the position takes place continuously. In such an embodiment, the cutting blade carries out a preferably slow continuous movement in which it is adjusted to and fro, for example, along a predefined track. In this manner the blade wear is distributed over the total area on the continuous adjustment. The speed of the adjustment movement can in this respect be relatively small.

In accordance with an embodiment, the automatic adjustment of the position can also occur intermittently. An alignment movement occurs in this case only at certain times, wherein the relative position between the cutting blade and the product remains constant in the meantime. In this respect, the cutting blade can be adjusted respectively between individual predefined positions.

In particular, the automatic adjustment of position can take place once a respective predefined number of slices have been cut. This enables a reliable optimization of the blade wear as this is in direct correlation to the number of slices cut. In such an embodiment, the cutting blade can be further adjusted each time when an unallowably high blade wear is to be feared due to a number of performed cuts having taken place since its last adjustment.

The automatic adjustment of the position can also take place in predefined time intervals, in particular, at regular time intervals. Such an automatic adjustment can be implemented in a particularly simple manner.

In accordance with a further embodiment, a degree of wear or a state of wear of the cutting blade is determined during the cutting and the automatic adjustment of the position takes place in dependence on the determined degree of wear or on the determined state of wear. The blade wear is thus not determined by means of the number of the cuts performed or the time lapsed, but is directly determined in this embodiment. For example, for the determination of the actual blade wear, a sensor can be provided which detects the state of wear of the cutting blade and transmits this to a control unit.

Preferably, the degree of wear or the state of wear of the cutting blade is determined in that a state of the product slices cut off by means of the cutting blade is detected and/or a state of portions of product slices generated during the slicing is detected. Changes with regard to the state of the sliced products can namely indicate an increased blade wear. For example, on reaching a certain degree of blade wear this can lead to an incorrect stacking of the cut-off product slices or to a folding over of the sliced product slices. Such irregularities with regard to the state of the cut-off product slices or portions are easily detectable, for example, by means of optical sensors.

The automatic adjustment of the position can, in particular, take place on reaching a predefined degree of wear or a state of wear. The adjustment process can thus be carried out in good time before reaching the wear related inacceptable degradation of the slicing qualities. Through the automatic adjustment it is ensured that a so far less loaded and for this reason a less worn section of the cutting blade is incident on the product. In this manner, each position of the blade edge is subjected to the maximum load within the usable range until the blade wear at this position reaches a critical size.

The cutting blade can be moved by means of an adjustment device for the automatic adjustment of the position. The adjustment device can, for example, be actuated electrically or hydraulically and be controlled by a control unit of the cutting apparatus.

For the automatic adjustment of the position, a blade head including the cutting blade for a cutting head can also be moved as a whole by means of an adjustment device, wherein in particular the cutting head includes a blade head, a rotary drive for the blade head and a cutting head housing. This enables a particular simple design. Certain slicing apparatus have a blade head or a cutting head which can be configured adjustable from the start, for example, to account for different product sizes or product types. This adjustability can be used in an advantageous manner for the optimization of the blade wear.

Alternatively or additionally to a movement of the cutting blade for the automatic adjustment of the position, at least one component of the product feed, in particular, a product support, a side abutment and/or a cutting edge is moved by means of an adjustment device holding, supporting and/or guiding a product is moved for the automatic adjustment of the position. Thus, in dependence on the field of application, the cutting blade, the product or both the cutting blade and also the product can thus be selectively moved for the automatic adjustment of the relative position between cutting blade and product.

In accordance with an embodiment of the invention, the position of the cutting blade is adjusted relative to the product in an adjustment direction or an adjustment plane running transverse to the product feed direction. The adjustment direction, can for example, run perpendicular to the product feed direction. A height adjustment, a lateral adjustment or a superposition of both can occur. The adjustment movement can, however, basically also have an axial component with regard to the product feed direction.

Advantageously, the position of the cutting blade is adjusted relative to the product within a range of tolerances which is defined by those positions in which an acceptable slicing result is achieved. In this manner, it is ensured that the slicing quality is not influenced through the automatic adjustment of the position. The limits of the range of tolerances can, for example, be empirically determined.

In accordance with a further embodiment, the automatic adjustment of the position is repeatably performed between predefined positions and/or along a predefined track. In this manner, the blade load can be reliably distributed between the predefined positions or over the complete range of the predefined track.

The invention also relates to an apparatus for the slicing of food products, in particular a high performance slicer, having a product feed which feeds a product to be sliced along a feed direction through a cutting plane in which it at least one cutting blade moves, in particular in a rotary manner and/or a revolving manner, wherein the position of the cutting blade is adjustable relative to the product by means of an adjustment device. In accordance with the invention a control unit is provided which is designed to automatically adjust the position of the cutting blade for the optimization of the blade wear.

The adjustment apparatus can be configured to move the cutting blade or a blade head including the cutting blade or a cutting head relative to the product.

Furthermore, at least one sensor can be provided which is connected to the control unit to detect a degree of wear or a state of wear of the cutting blade.

Alternatively or additionally, at least one sensor can be provided which is connected to the control unit to monitor a state of the product slices cut off by means of the cutting blade and/or to monitor a state of portions of cut-off product slices during the slicing.

For an operator of such slicing apparatuses, the advantage is thus obtained that an exchange or a re-sharpening of the cutting blade is required less frequently.

The invention will be described in the following with reference to the drawings.

LIST OF REFERENCE NUMERALS

Figure 1:
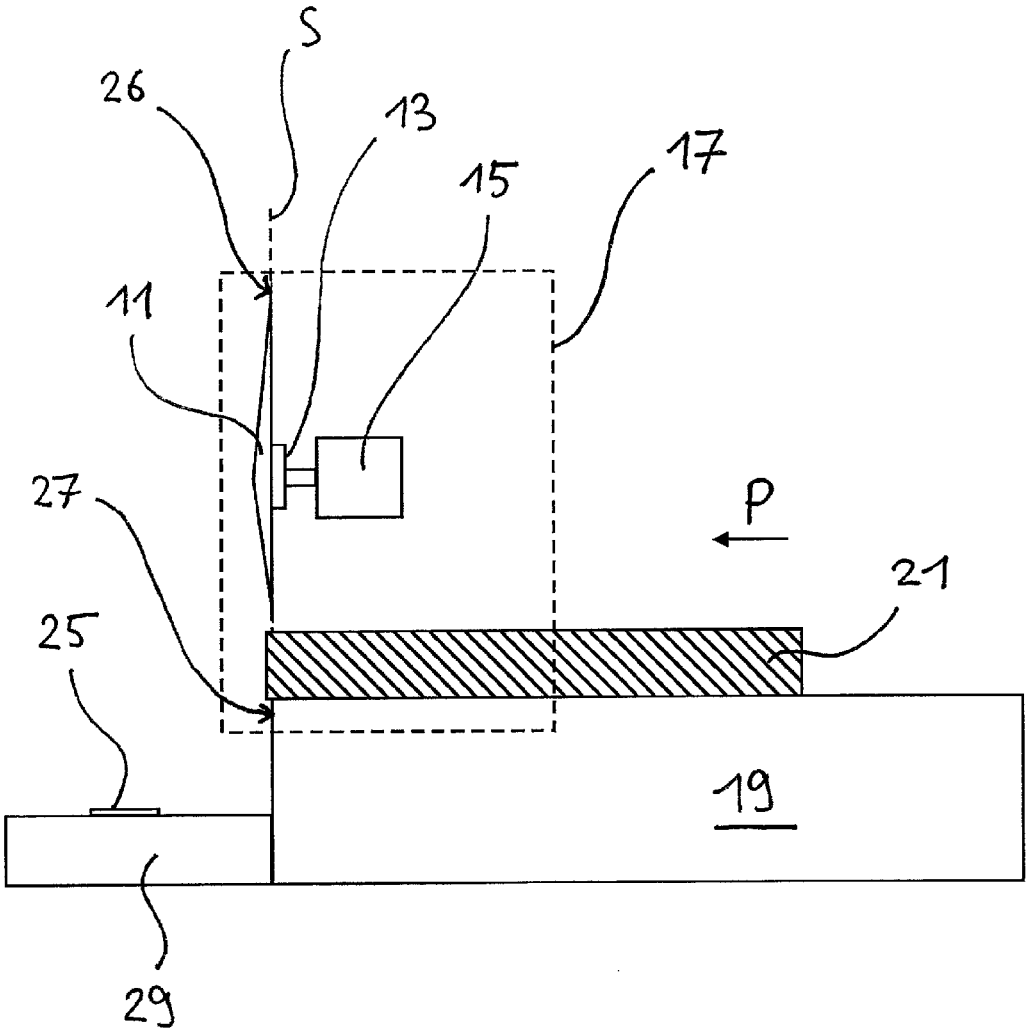
FIG. 1 shows a simplified side view of an apparatus in accordance with the invention for the slicing of food products.

11, 11' cutting blade
13 blade head
15 drive
17 cutting head
19 product feed
21, 21' product bar
23 side abutment
25 product disc
26 blade edge
27 cutting edge
29 product support
31 sensor
33 adjustment device
35 circular track
S cutting plane
P product feed direction

DETAILED DESCRIPTION

Figure 2:
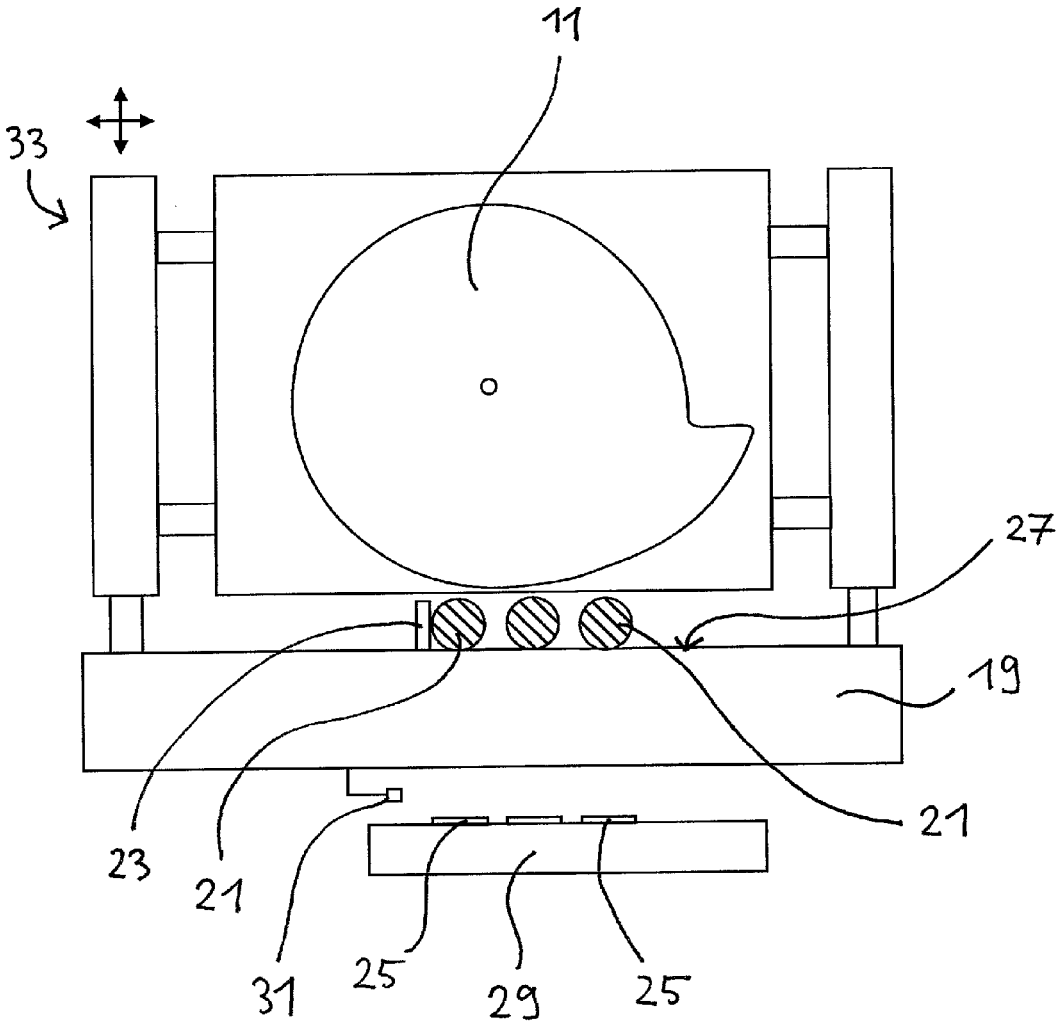
FIG. 2 shows a front view of the apparatus in accordance with FIG. 1.

In accordance with FIG. 1 and FIG. 2, a high performance slicer includes a cutting blade 11 which defines a cutting plane S. The cutting blade 11 is formed as a disc-shaped sickle blade in this embodiment which is attached at a blade head 13. The blade head 13 having the cutting blade 11 is driven in the cutting plane S in a rotary manner by means of a drive 15. The cutting blade 11 including the blade head 13 and the drive 15 is integrated into a cutting head 17 which is illustrated merely by dotted lines in FIG. 1. For reasons of safety, the cutting head 17 is covered by a cutting head housing which is, however, not illustrated in detail in the Figures.

The high performance slicer, moreover, includes a product feed 19 on which three product bars 21 to be cut up are arranged beside one another. The product bars 21 are fed along a product feed direction P to the rotating cutting blade 11 perpendicular to the cutting plane S by means of a non-illustrated controlled drive. During the product feed, the arrangement of product bars 21 is guided along a side abutment 23 illustrated in FIG. 2. Further measures for holding, supporting and/or feeding of the product bar 21 can be provided in dependence on the requirements.

During the rotation the cutting blade 11 slices through the product bar 21 with a blade edge 26 and cuts off product slices 25 from this, wherein it cooperates with the a cutting edge 27 forming the end of the product feed 19. The cut-off product slices 25 fall onto a product support 29 on the backside of the blade remote from the product feed 19 and can be delivered further and/or processed further, in particular be delivered to an automatic packaging plant (not illustrated). A sensor 31 (FIG. 2) serves to monitor the quality of the product slices 25 located at the product support 29. The sensor 31 is connected to a control unit of the high performance slicer which is not illustrated.

The cutting head 17 having the cutting blade 11, the blade head 13 and the drive 15 can be moved as a whole relative to the product feed 19 with the product bars 21. For this purpose an adjustment device 33 is provided, as is shown in FIG. 2, which is activated by the control unit. The cutting head 17 is moved with the cutting blade 11 within the cutting plane S in vertical and/or horizontal direction by means of the controlled adjustment device 33 which is indicated in FIG. 2 by the crossed arrows.

During the cutting operation the sensor 31 continuously monitors the slice result, i.e. the state of the cut-off product slices 25 and the state of the portions generated during the cutting of the product slices 25. The control unit checks whether the quality of the cut-off product slices 25 or the respective portions is sufficient and whether the stacking occurs correctly by means of the sensor signals.

As soon as irregularities with regard to the state of the product slices 25 or the portions are determined i.e., for example, folded over product slices 25 are detected on the product support 29, the cutting head 17 is moved by means of the adjustment device 33 by a predefined distance to the side or upwards. Preferably, the predefined distance amounts to a mere few millimeters. Through the change of the relative position between the cutting blade 11 and the product bar 21 it is effected that a different position of the blade edge 26 is incident on the product bar 21 than before. In this configuration, the slicing operation can be carried out interference-free until an unallowed influence of the slicing quality or the stacking is determined by means of the sensor signals. A re-sharpening or an exchange of the cutting blade 11 is thus only required significantly later than for a concentration of the blade load and thus of the blade wear on one and the same position of the blade edge 26. The control unit ensures that the adjustment movement remains limited to a range of tolerances within which an acceptable slicing result is achievable. A service is then only required when the blade wear is unallowably high within the overall range of tolerances.

To save the use of the sensor 31, the control unit could also be programmed such that the automatic adjustment of the position takes place independent of the determined degree of wear or state of wear following a predefined number of performed slices or at predefined time intervals.

Figure 3:
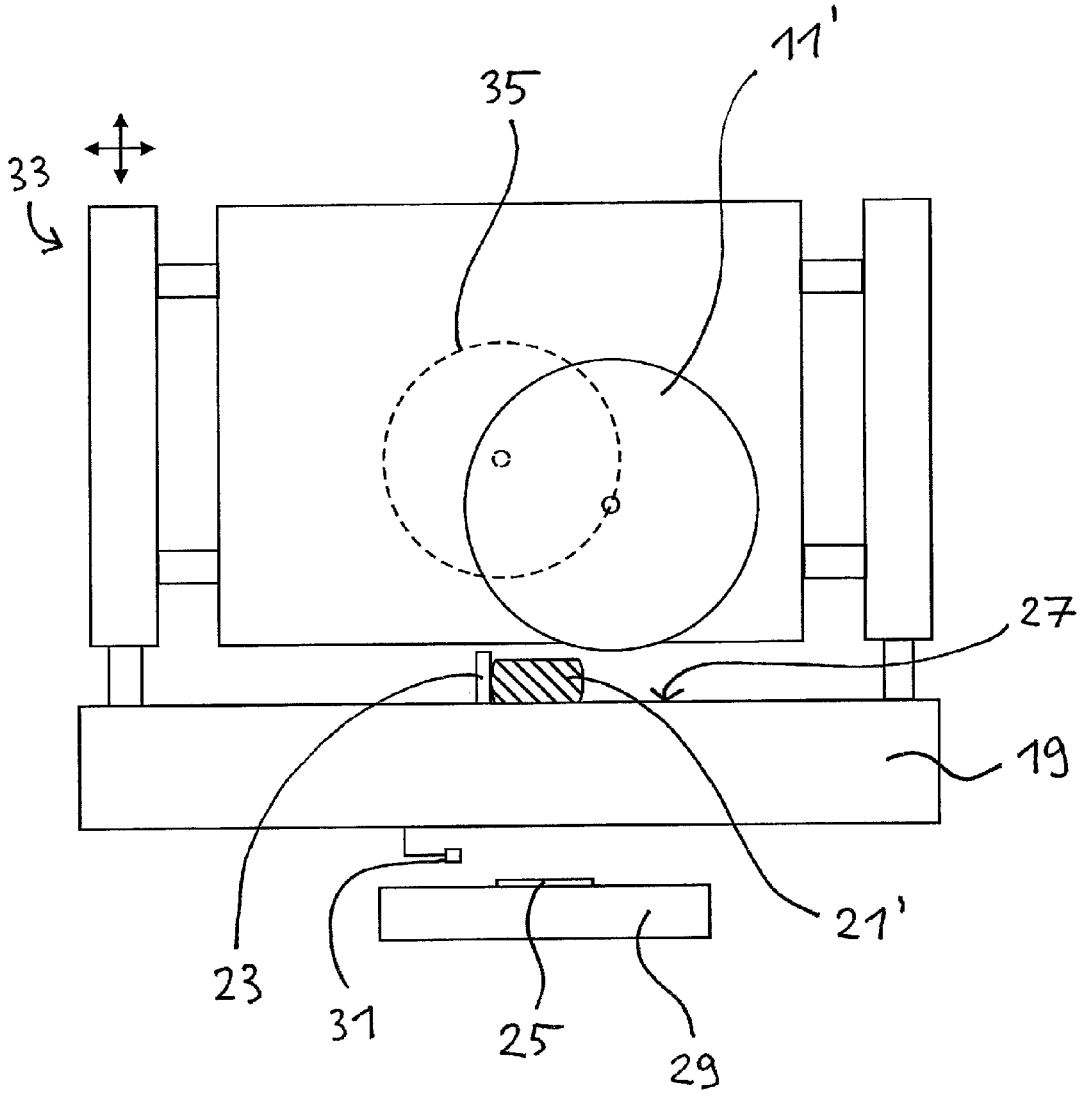
FIG. 3 shows a front view of an apparatus for the slicing of food products in accordance with an alternative embodiment of the invention.

FIG. 3 shows a high performance slicer in accordance with an alternative embodiment of the invention. The cutting blade 11' is formed as a circular blade here, which revolves on a circular track 35 in planetary motion. Instead of a plurality of product bars being arranged besides one another merely a single product bar 21 is located on the product feed 19. The adjustment device 33 is moreover equivalent to the one shown in the embodiment of FIG. 2.

The adjustment device, the size of the range of tolerances, as well as the timely coordination of the automatic adjustment can be matched to the respective application in a plurality of ways for the described embodiments. The invention as a whole enables maintenance intervals which are timely separated further apart and thus an economic operation of a high performance slicer.

What is claimed is:

1. A method for slicing food products, comprising:

feeding a product along a product feed direction by means of a product feed through a cutting plane in which at least one cutting blade moves in a rotary manner, a revolving manner, or a combination thereof;

monitoring a quality of product slices generated as the at least one cutting blade slices the product; and automatically adjusting a position of the at least one cutting blade relative to the product based on the quality of the product slices for optimization of wear of the at least one cutting blade.

2. A method for slicing food products, comprising:

feeding a product along a product feed direction by means of a product feed through a cutting plane in which at least one cutting blade moves in a rotary manner, a revolving manner, or a combination thereof; and automatically adjusting a position of the at least one cutting blade relative to the product for optimization of wear of the at least one cutting blade, wherein the position of the at least one cutting blade is adjusted relative to the product within a range of tolerances which is defined by those positions in which an acceptable slicing result is achievable.

3. A method in accordance with claim 2, wherein said food products are sliced by means of a high performance slicer.

4. A method in accordance with claim 2, wherein the automatic adjustment of the position takes place during the slicing.

5. A method in accordance with claim 2, wherein the automatic adjustment of the position takes place continuously.

6. A method in accordance with claim 2, wherein the automatic adjustment of the position takes place intermittently.

7. A method in accordance with claim 6, wherein the automatic adjustment of the position respectively takes place following a predefined number of performed slices.

8. A method in accordance with claim 6, wherein the automatic adjustment of the position takes place at predetermined time intervals.

9. A method in accordance with claim 2, wherein a degree of wear or a state of wear of the at least one cutting blade is determined during the slicing and the automatic adjustment of the position takes place in dependence on the determined degree of wear or on the determined state of wear.

10. A method in accordance with claim 9, wherein the automatic adjustment of the position takes place on reaching a predefined degree of wear or state of wear.

11. A method in accordance with claim 2, wherein the at least one cutting blade is moved by means of an adjustment device for the automatic adjustment of the position.

12. A method in accordance with claim 2, wherein a blade head including the at least one cutting blade or a cutting head is moved as a whole by an adjustment device for the automatic adjustment of the position.

13. A method in accordance with claim 12, wherein the cutting head includes a blade head, a rotary drive for the blade head, and a cutting head housing.

14. A method in accordance with claim 2, wherein at least one component of the product feed is moved by means of an adjustment device for the automatic adjustment of the position, wherein the adjustment device is configured for holding the product, supporting the product, guiding the product, or a combination thereof.

15. A method in accordance with claim 14, wherein said at least one component is selected from the group including a product support, a side abutment, and a cutting edge.

16. A method in accordance with claim 2, wherein the position of the at least one cutting blade is adjusted relative to the product in an adjustment direction or an adjustment plane running transverse to the product feed direction.

17. A method for slicing food products, comprising:

feeding a product along a product feed direction by means of a product feed through a cutting plane in which at least one cutting blade moves in a rotary manner, a revolving manner, or a combination thereof; and automatically adjusting a position of the at least one cutting blade relative to the product for optimization of wear of the at least one cutting blade, wherein a degree of wear or a state of wear of the at least one cutting blade is determined during the slicing and the automatic adjustment of the position takes place in dependence on the determined degree of wear or on the determined state of wear, wherein the degree of wear or the state of wear of the at least one cutting blade is determined in that a) a state of the product slices cut off by means of the at least one cutting blade is detected, b) a state of portions of product slices generated during the slicing is detected, or c) both.

18. A method for slicing food products, comprising:

feeding a product along a product feed direction by means of a product feed through a cutting plane in which at least one cutting blade moves in a rotary manner, a revolving manner, or a combination thereof; and automatically adjusting a position of the at least one cutting blade relative to the product for optimization of wear of the at least one cutting blade, wherein the automatic adjustment of the position is repeatedly performed between predefined positions, along a predefined track, or both.

19. An apparatus for slicing food products, comprising:

a product feed which feeds a product to be sliced along a product feed direction through a cutting plane in which at least one cutting blade moves in a rotary manner, a revolving manner, or a combination thereof;

an adjustment device for adjusting a position of the at least one cutting blade relative to the product; and a control unit for automatically adjusting the position of the at least one cutting blade within a predetermined range for optimization of wear of the at least one cutting blade, wherein the predetermined range is based on a quality of product slices generated as the at least one cutting blade slices the product.

20. An apparatus in accordance with claim 19, wherein said apparatus is a high performance slicer.

21. An apparatus in accordance with claim 19, wherein the adjustment device is configured to move the at least one cutting blade or a blade head including the at least one cutting blade or a cutting head relative to the product.

22. An apparatus in accordance with claim 19, further comprising at least one sensor connected to the control unit for detecting a degree of wear or a state of wear of the at least one cutting blade.

23. An apparatus in accordance with claim 19, further comprising at least one sensor connected to the control unit for monitoring a state of the product slices cut off by the at least one cutting blade, monitoring a state of portions of cut-off product slices during the slicing, or both.

* * * * *